US006106383A

United States Patent [19]

Kalokhe et al.

[11] Patent Number: 6,106,383

[45] Date of Patent: Aug. 22, 2000

[54] INTEGRAL AIR GAGE FOR RELEASABLE CYLINDRICAL TOOL BODY

[75] Inventors: Shivdas Kalokhe, Holland; Mark L. Becksvoort, Hamilton, both of Mich.

[73] Assignee: Micromatic Operations, Inc., Holland, Mich.

[21] Appl. No.: 09/282,592

[22] Filed: Mar. 31, 1999

Related U.S. Application Data

[63] Continuation-in-part of application No. 08/897,722, Jul. 21, 1997.

[51] Int. Cl.[7] ..... B24B 9/02

[52] U.S. Cl. ..... 451/470; 451/472; 451/476

[58] Field of Search ..... 451/470, 472, 451/476, 478, 481

[56] References Cited

U.S. PATENT DOCUMENTS

| | | | |
|---|---|---|---|
| 2,787,865 | 4/1957 | Gross | 51/34 |
| 4,075,794 | 2/1978 | Blaylock | 51/340 |
| 4,437,267 | 3/1984 | Corley | 51/34 R |

*Primary Examiner*—Timothy V. Eley
*Assistant Examiner*—Dung Van Nguyen
*Attorney, Agent, or Firm*—Perman & Green, LLP

[57] ABSTRACT

An air gage is integrally constructed within a honing tool having a body formed as a removable outer shell on which is mounted the abrasive elements of the tool. The shell is mounted on a mandrel which contains means to adjust the radial position of the abrasive elements which engage the adjustment means through slots in the shell. The air gage allows monitoring of tool performance during a honing operation.

6 Claims, 7 Drawing Sheets

INTEGRAL AIR GAGE FOR RELEASABLE CYLINDRICAL TOOL BODY

This application is a continuation in part of Ser. No. 08/897,722 filed Jul. 21, 1997.

BACKGROUND OF THE INVENTION

Machines for boring and finishing cylindrical holes such as engine cylinder bores use a tool having abrasive strips mounted on a cylindrical body. As these tools wear, they are generally adjusted radially outward to compensate for the depletion of the abrasive surface. The wear compensating adjustment mechanism forms part of the tool body and comes in many shapes and sizes for example the tool shown and described in U.S. Pat. No. 4,075,794. These tools consist of a mandrel which connects to the machine spindle at one end and is constructed with an abrasive head at the other. A connecting rod connects to an adjustment mechanism within the abrasive head to bias the abrasive elements radially outward against the work piece. The adjustment can be accomplished automatically as shown in the '794 patent or manually as shown in the reference Gross, U.S. Pat. No. 2,787,865.

The problem with tools of this type is that they are complex mechanisms which have to be continuously removed from the machine spindles for repairs, replacement of abrasives and maintenance. Each time this occurs, an expensive part of the machine is unproductive. It requires skill and care to make sure that the tool mechanism is properly installed. Since the tool assembly of the prior art may weigh between 15 to 20 pounds, servicing of this element becomes a significant effort and is awkward for a single operator to accomplish.

It is the purpose of this invention to provide a tool body which is removable from the mandrel in a convenient and reliable manner to allow maintenance of the abrasive elements without extensive effort. The tool body of this invention significantly reduces the weight which needs to be handled during servicing or replacement of the abrasive elements and this tool body is a much less expensive part to replace than comparable parts in the prior art.

SUMMARY OF THE INVENTION

A tool body for use in a honing machine is constructed in the form of a cylindrical shell having an internal axially extending bore open at its outer and inner ends. A plurality of axial aligned channels designed to receive the abrasive assemblies are formed in its outer periphery. Each abrasive assembly consists of a specially designed tool holder and an abrasive element. The assemblies are held in place by flexible rings which allow radial movement of the element within its channel. At the bottom of each channel is an elongated slot which provides access to the tool holder from the internal bore for the expander mechanism. At the entrance to the bore at its inner end, a torque transmitting engagement surface is formed. A mandrel is constructed to house the expander mechanism for the abrasive assembly and is connected to the spindle of the machine through an elongated shaft. The mandrel is designed for insertion into the internal bore of the tool body to allow the tool body to be releasably mounted thereon. A fixed drive element projects radially outward from the periphery of the mandrel to engage the torque transmitting surface of the tool body in a mating relation to transmit torque to the tool body. The expander mechanism is designed to convert an axial force down the shaft of the mandrel to a radial force directed outward on the tool holders through a series of wedge shaped surfaces.

In order to allow continuous monitoring of tool performance during the honing operation, an air gage is integrally constructed within the releasable tool body. The air gage connects to a supply of pressurized air through a junction which is constructed in an enlarged annular flange formed on the mandrel.

DESCRIPTION OF THE DRAWING

The invention is described in more detail below with reference to the attached drawing in which.

DESCRIPTION OF THE PREFERRED EMBODIMENT

Figure 5:
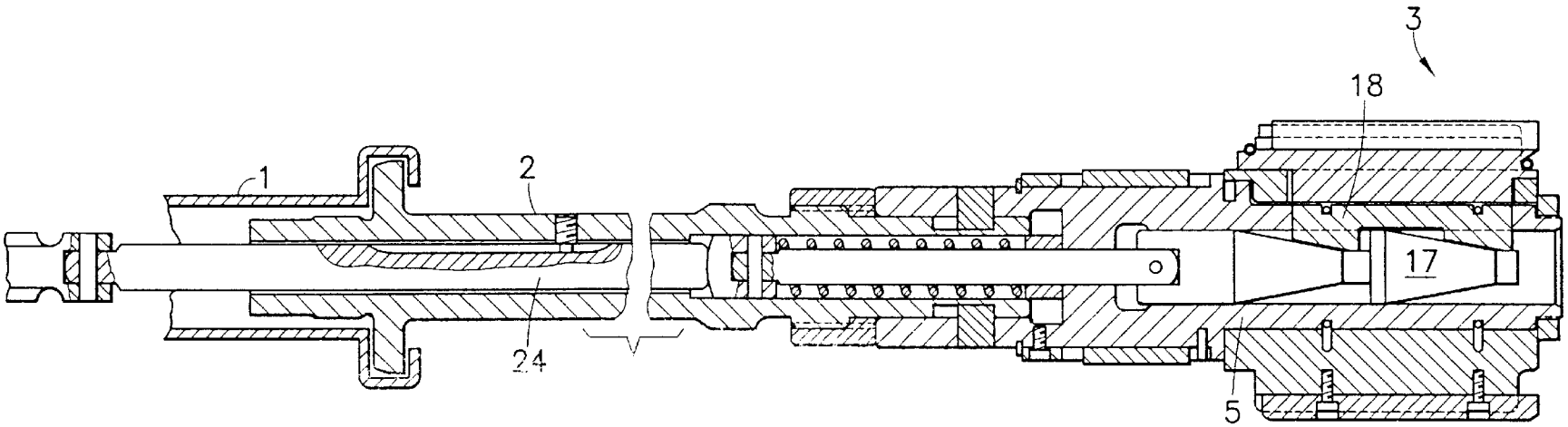
FIG. 5 is a cut away view of the entire tool assembly from tip to spindle.

A tool mechanism, as shown in FIG. 5, is constructed for installation on spindle 1 of a honing machine (not shown). The tool consists of an elongated support shaft 2 and tip 3. It is the assembly of tip 3 to which this invention is directed.

Figure 1:
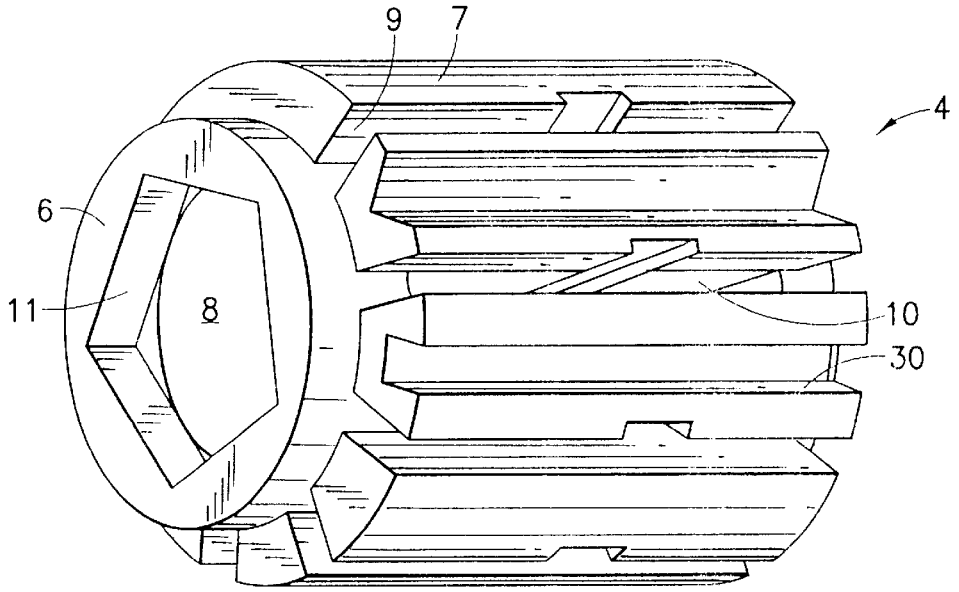
FIG. 1 is a perspective view of the tool body of this invention.
Figure 3:
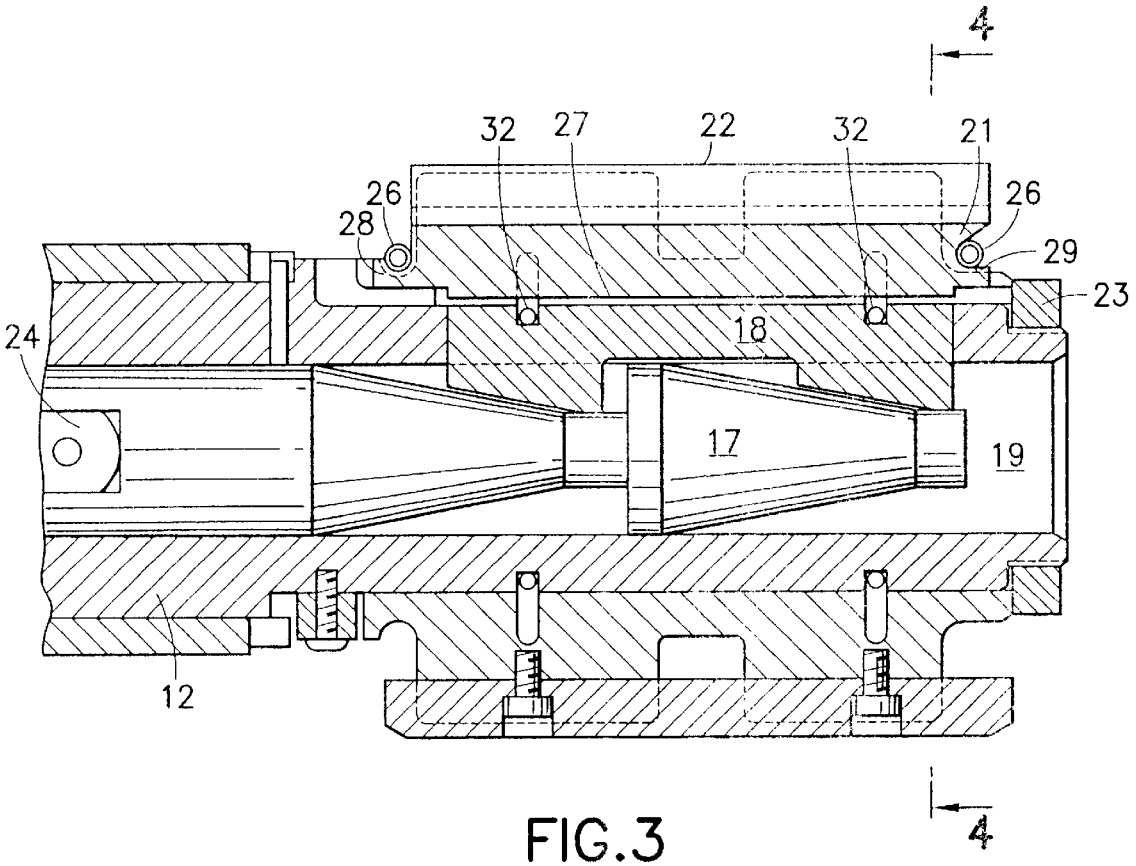
FIG. 3 is a cut away view of the mandrel and tool body assembly showing the internal parts of the expander mechanism.
Figure 4:
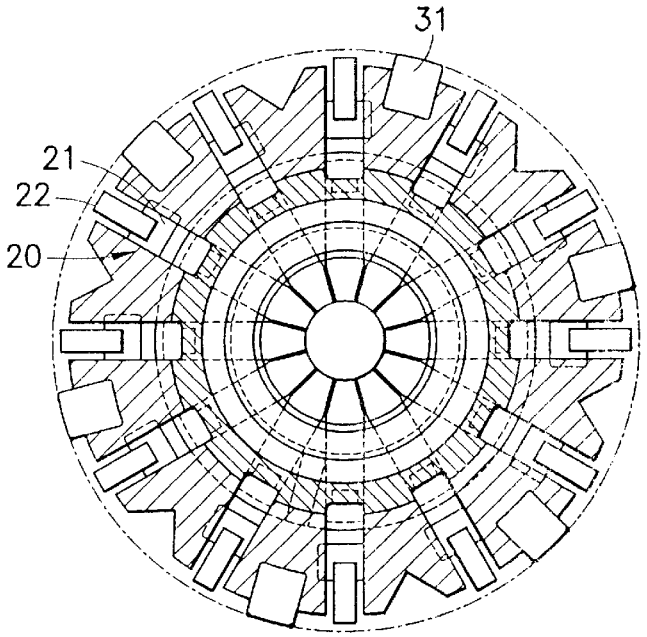
FIG. 4 is an end view of the mandrel and tool body assembly at section lines 4—4.

Tip 3 is an assembly of tool body 4 and mandrel 5. As shown in FIG. 1, tool body 4 is constructed as a shell having an outer periphery 7, an inner end 6, and an internal axial bore 8. Channels 9 are formed in the outer periphery 7 and extend axially to receive an abrasive assembly 20. The abrasive assembly 20 consists of a holder 21 and an abrasive block 22. The abrasive holder 21 is constructed with a bottom surface 27 for engagement with the expander element 18, described below. Holder 21 is held in place by elastic springs 26, as shown in FIG. 3. O-rings 26 engage projections 28 and 29 on either end of the holder 21. Additional channels 30 extend axially on the body 4 to receive guides members 31.

Elongated slots 10 are constructed at the base of the channel 9 which communicate with the internal bore 8 to provide access to the abrasive holder 21 from within. Inner end 6 contains a hexagonal recess 11 to receive a mating drive surface 15 on the mandrel 5. Although a hex head engagement is illustrated, any appropriate engagement can be made to allow transmission of torque directly to the tool body 4. For example, a lug and slot or gear type engagement would work also.

Figure 2:
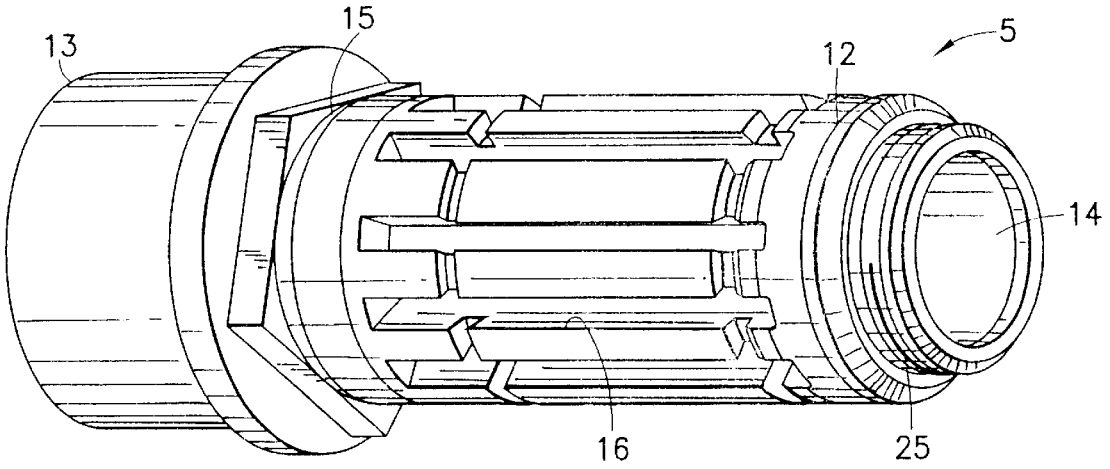
FIG. 2 is a perspective view of the mandrel of this invention.

The mandrel 5 of this invention is shown in FIG. 2 and has cylindrical housing 12 sized to fit into the bore 8 of tool body 4. Mandrel 5 houses the tip portion of the expander mechanism identified by elements 17 and 18 shown in FIG. 3. The cam element 18 is held in place by elastic springs 32. The mandrel 5 has a drive surface 15 extending radially outward from its inner end 13 with a hexagonal shape to mate with the recess 11 of tool Body 4. The housing 12 is constructed with an inner chamber 19 in which the expander mechanism extends. Housing 12 is constructed with slots 16 through which the expander element 18 extends for operative engagement with the bottom surface 27 of holder 21. This engagement is accomplished through the aligned slots 10 in tool body 5 and slots 16 in mandrel housing 12. The outer end of mandrel 5 has a threaded portion 25 to receive the threaded end cap 23 which serves to secure the tool body 4 on the mandrel 5.

As shown in FIG. 5, the expander cam 17 is mounted at the tip end of an adjustment rod 24 which extends longitudinally within the support shaft 2 and connects with appropriate operating mechanisms within the spindle 1. The actuating rod 24 pushes downward causing cam 17 outward. A radial force is exerted on expander element 18 which is in contact with the surface 27 of holder 21. Axial movement of the adjustment rod 24 will, therefore, move the abrasive assembly 20 outward to compensate for wear.

In operation, when repairs, maintenance, or replacement need to be accomplished only the tool body 4 needs to be removed. It can easily be removed by unscrewing end cap 23. Since only the tool body is needed, it is economical to have multiple replacement bodies in inventory. This would not be feasible without the releasable tool of this invention.

Air Gage

It is important to obtain on going information relating to the progress of the honing process in order to determine the performance of the tools and the accuracy of the material removal. In addition, as the abrasive surfaces wear during use, there needs to be an adjustment of the tools to insure continuous engagement with the work piece. The required data is obtained by sensing the amount of material being removed during a stroke of the honing machine.

In prior art machines, the needed data is obtained by the use of an air gage plug which applies a pressurized air stream to the work piece surface. The air gage plug may be inserted into a bore being machined before or after the honing operation as shown in U.S. Pat. No. 4,437,267. In the relatively closed environment between the air gage nozzle and the work piece, changes in air pressure within the gage system may be sensed and will be proportional to the amount of material being removed. In this manner the progress of the process can be monitored.

Figure 6:
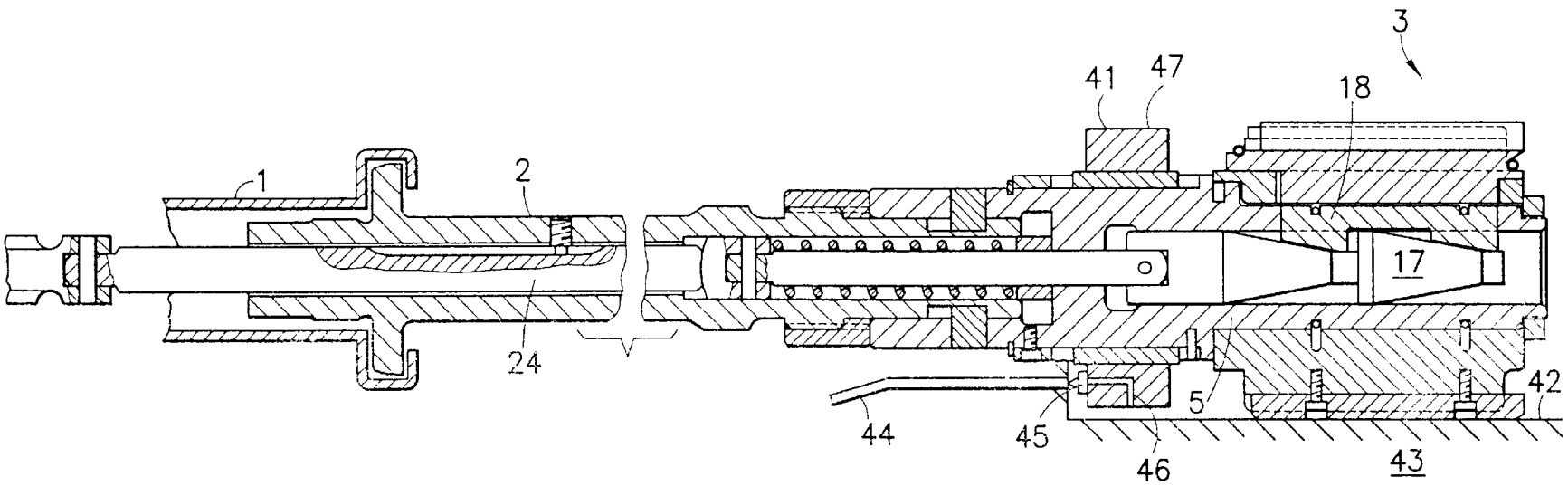
FIG.6 PRIOR ART
FIG. 6 is a view similar to FIG. 5 showing the use of an air gage ring.

As shown in FIG. 6, in the prior system described above, an air gage ring 41 may be used to apply air under pressure to the inner surface 42 of cylinder bore 43. The pressurized air is supplied to the gage ring 41 by a tube 44 attached to the gage ring by nipple 45. A nozzle 46 is provided on the external circumference 47 of the gage ring 41 directing the flow of air radially outward. The data obtained in this manner is necessarily at the end of the honing stroke.

It is the purpose of this invention to provide continuous gaging of the cylinder bore being machined by providing an integral air gage for releasable tool body 4. This will allow the sensing of data during the actual honing stroke instead of before or after the operation as is common in the prior art.

Figure 7:
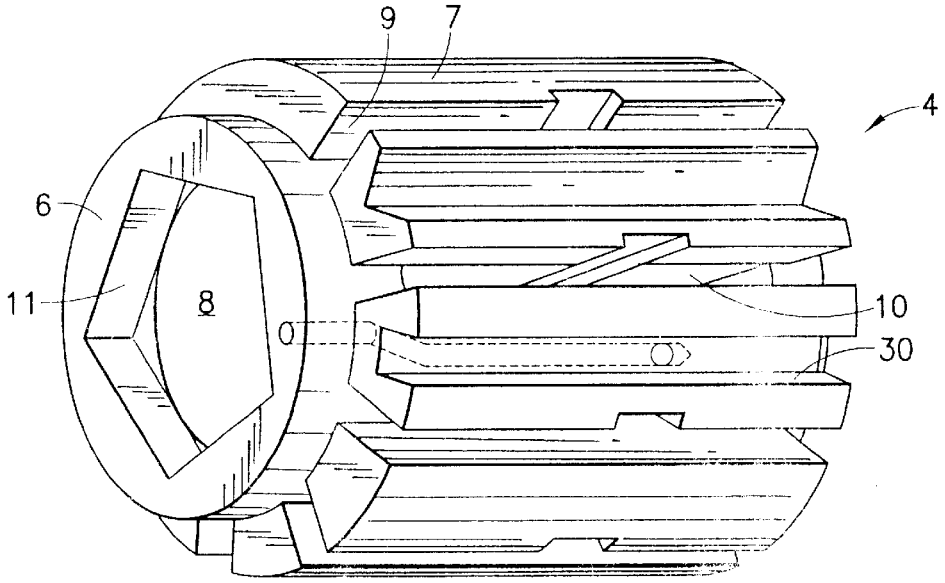
FIG. 7 is a perspective view of the releasable tool body having an air gage passage.
Figure 8:
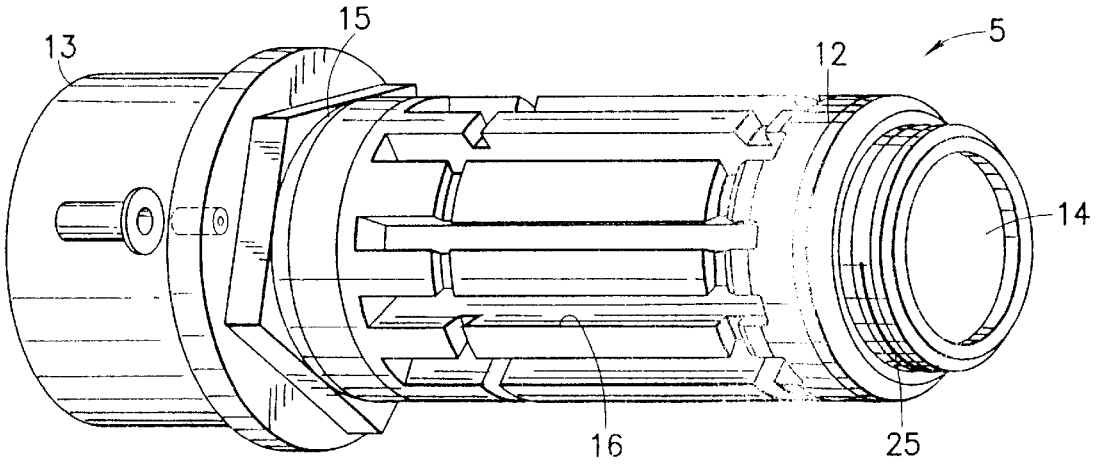
FIG. 8 is a perspective view of the mandrel showing the air supply junction for the air gage.
Figure 9:
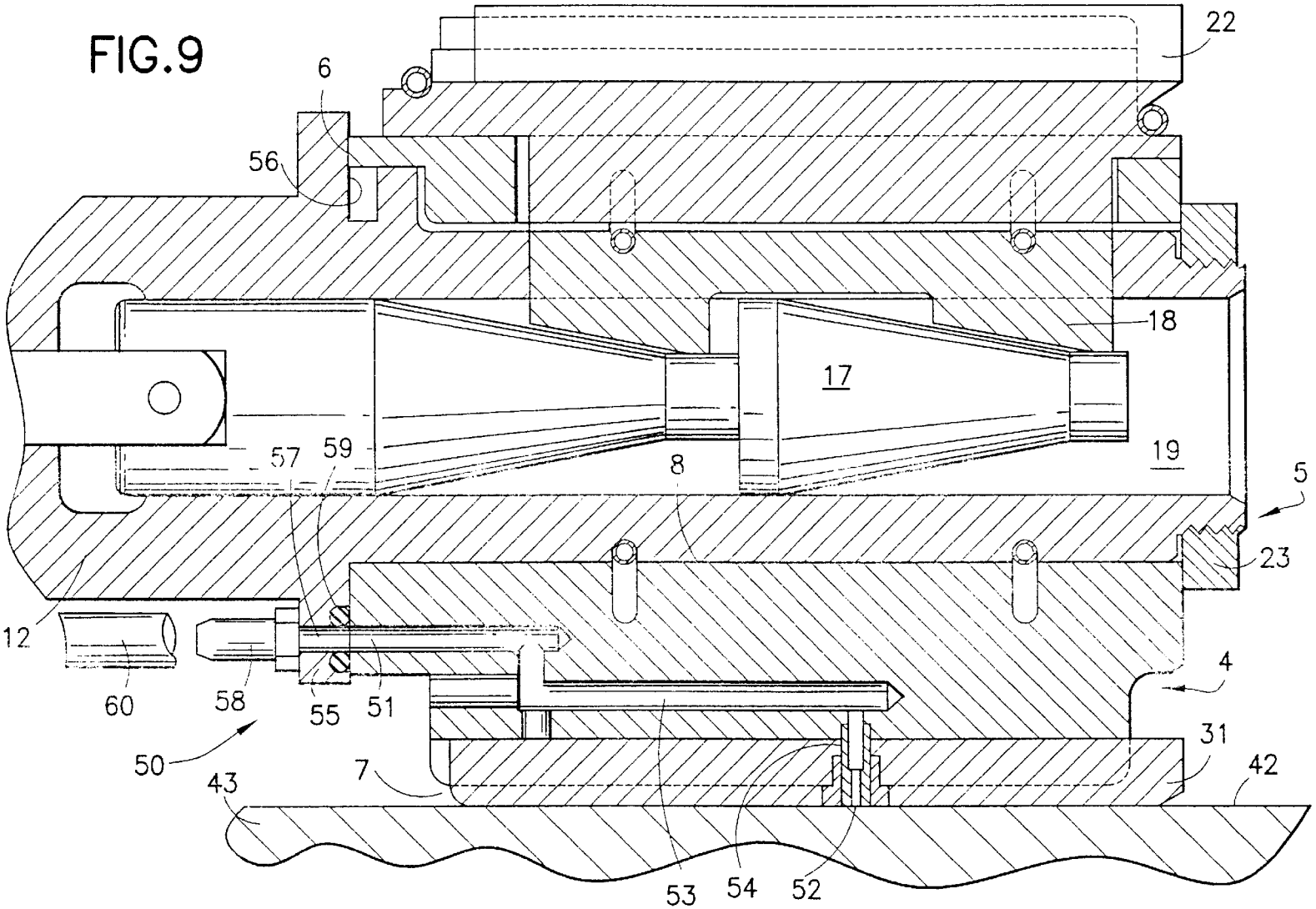
FIG. 9 is a sectional view of the assembled tool body and mandrel showing the air gage.

As shown in FIGS. 7 through 9, the air gage system 50 of this invention consists of a passage 53 constructed in the releasable tool body 4 which communicates between an inlet 51 in the inner end 6 and a nozzle 52 constructed in the guide member 31. To accomplish this, passage 53 is drilled into the end 6 of tool body 4 extending longitudinally parallel to the axis. Depending on the space available, it may require a series of interconnecting drilled passages, as shown in FIG. 9. Guide member 31 is also drilled with radial nozzle 52 aligned with the outlet 54 of passage 53. In this manner an uninterrupted supply passage is constructed from the end 6 of the tool body 4 to the outer periphery 7 thereof.

To accommodate the supply junction for the air gage, an enlarged annular flange 55 is constructed on the mandrel 5 to act as a seat for the inner end 6 of the tool body 4. The face 6 will engage the surface 56 of flange 55 and will be held in tight contact by end cap 23. A supply passage 57 is drilled through the flange 55 and is constructed to receive a nipple 58. The nipple 58 may be secured within the supply passage 57 by threads or other means to provide a sealed connection joint. Passage 57 has an exit in face 56 which is constructed with an annular groove to accommodate an O-ring type seal 59. Seal 59 is preferably a material which compresses upon contact with face 6 to form a seal between supply passage 57 and air gage passage 53. Air under pressure is supplied from an external source through supply tube 60 which engages nipple 58.

Figure 10:
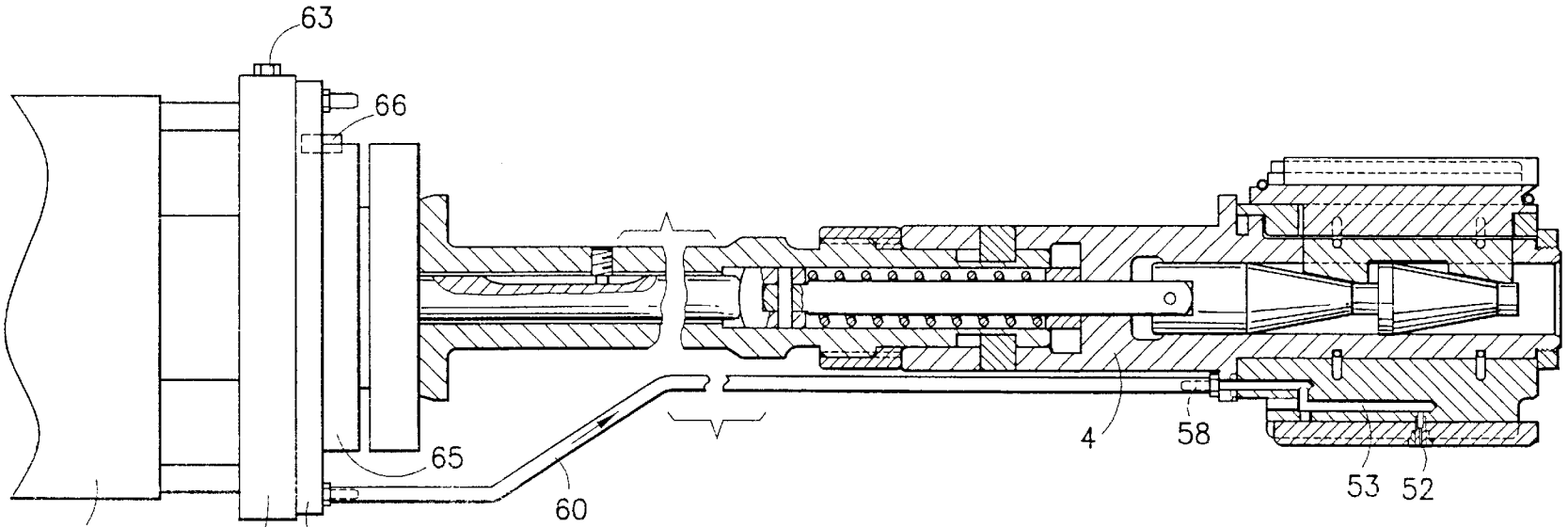
FIG. 10 is a side view of the spindle and tool assembly of this invention partially cut away.

As shown in FIG. 10, a rotary air coupling consisting of mating elements 61 and 62 is attached to the spindle body 64. The element 62 is stationary and is attached to spindle body 64. Air inlet 63 is constructed in the stationary element 62. The part 61 rotates with the tool body 4. Air supply tube 60 is connected between rotating 61 of the coupling and connection '58 attached to tool body 4. The rotary part '61 is keyed to tool adapter body '65 by key 66. The tool body 4 is mounted to tool adapter 65, which in turn is mounted to the spindle face. As the spindle rotates, the tool adapter 65, tool body 4 and rotary element 61 of coupling rotate together. Air enters through inlet '63 of stationary part '62 of the coupling, and into rotary part '61. It goes to nozzle 52 via tube 60 and passage 52.

During assembly the inlet 51 of passage 53 must be aligned with the supply passage 57. This can be accomplished easily because the tool body 4 is locked from relative rotation with the mandrel 5 by the torque transmitting interfaces 11 and 15. The passages are positioned to facilitate alignment as the torque transmitting engagement of the body 4 and mandrel 5 is accomplished.

In this manner and air gage system integral with the releasable tool body is completed. In operation, air pressure variations within the gage system, as sensed at the nozzle 52, are monitored and converted into signals for processing by an appropriately programmed computer or microprocessor. The signals are compared to predetermined data and a reading of tool performance is obtained. These readings provide the basis for controlling the honing process and tool adjustment.

We claim:

1. A tool assembly for use on a machine having a spindle for driving a tool to machine cylindrical bores comprising:

a removable tool body constructed in the form of a cylindrical shell having an internal axial bore, said shell having a plurality of channels formed in the outer periphery thereof, each channel having a slot constructed in the bottom thereof communicating with said internal axial bore, said body also having torque receiving means constructed therein;

a plurality of abrasive assemblies mounted within the channels for radial movement with respect to the tool body;

means mounted in the axial bore of the tool body to releasably support the tool body on the spindle, said mounting means including expander means in operative association with the abrasive assemblies through the channel slots to allow the adjustment of the radial position of said abrasive assemblies; and wherein said removable tool body is further constructed with an air gage integrally constructed therein for receiving a source of pressurized air and expelling said pressurized air outward from the outer periphery thereof, thereby enabling the sensing of variations in pressure at a remote location.

2. A tool assembly for use on a machine having a spindle for driving a tool to machine cylindrical bores as described in claim 1 wherein the mounting means further comprises:

a mandrel having a housing constructed to fit into the axial bore of the tool body to allow said tool body to be releasably mounted thereon, said housing having an inner chamber constructed therein and slots communicating with the inner chamber, said housing slots aligning with the slots of the tool body channels to form a continuous passage that permits access to the abrasive assembly from the inner chamber of the mandrel, said mandrel having torque transmitting means constructed therein to operatively engage the torque receiving means of the tool body;

wherein the expander means is mounted within the inner chamber of said mandrel and engage the abrasive assemblies through the aligned slots of the mandrel and tool body; and further wherein the mandrel is constructed with a junction comprising a connector to receive a supply of pressurized air and an inlet passage communicating with said air gage to transmit pressurized air thereto.

3. A tool for supporting abrasive elements on a spindle of a machine for honing cylindrical bores comprising:

a mandrel mounted on the spindle in operative association therewith;

a tool body having an outer periphery and end faces, said body containing the abrasive elements and mounted on the mandrel in operative association therewith, said tool body constructed to be releasably secured to the mandrel, and having an air gage integrally formed therein, said air gage comprising:

a source of pressurized air;

a gage passage constructed in the tool body having a gage inlet on an end face and a gage outlet on its outer periphery, said outlet forming a nozzle which allows air flowing in said passage to be directed outward therefrom; and a supply junction constructed on the mandrel and connected to the source of pressurized air, said junction constructed with a supply passage communicating with the gage inlet in a sealed relation to deliver pressurized air to the gage passage; and a pair of engagement elements constructed on the mandrel and tool body respectively which mate when said mandrel and body are assembled to maintain the supply passage in an aligned and sealed relation to the gage passage.

4. A tool for supporting abrasive elements on a spindle of a machine for honing cylindrical bores as described in claim 3 further comprising:

an annular flange extending radially outward from the mandrel having first and second surfaces, said supply passage being constructed to extend between said first surface and said second surface, said first surface forming an interface with the inlet end face of the tool body; and a sealing element seated on said interface at the joint of said supply passage and said gage inlet, said sealing element being held in place by engagement between said interface and said end face.

5. A tool for supporting abrasive elements on a spindle of a machine for honing cylindrical bores as described in claim 4 wherein said junction further comprises a nipple secured on said second face of said flange to form an inlet for the supply passage, said nipple constructed to receive a supply tube from the source of pressurized air.

6. A tool for supporting abrasive elements on a spindle of a machine for honing cylindrical bores as described in claim 3 wherein the outlet of the gage passage is in a slot constructed in the tool body to receive a guide member and said gage nozzle is constructed in the guide member.

* * * * *